US007091798B2

(12) United States Patent
Jocher

(10) Patent No.: US 7,091,798 B2
(45) Date of Patent: Aug. 15, 2006

(54) NOTCH FILTER SYSTEM AND METHOD

(75) Inventor: Ronald W. Jocher, East Hanover, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 391 days.

(21) Appl. No.: 10/223,877

(22) Filed: Aug. 20, 2002

(65) Prior Publication Data

US 2004/0036556 A1 Feb. 26, 2004

(51) Int. Cl.
*H01P 1/20* (2006.01)
*H01P 1/32* (2006.01)

(52) U.S. Cl. ..... 333/1.1; 333/202

(58) Field of Classification Search ..... 333/1.1, 333/242, 202

See application file for complete search history.

(56) References Cited

U.S. PATENT DOCUMENTS 5,129,099 A * 7/1992 Roberts ..... 455/81
5,721,521 A * 2/1998 Drabeck et al. ..... 333/202
6,374,094 B1 * 4/2002 Zappala ..... 455/188.1

* cited by examiner

*Primary Examiner*—Stephen E. Jones
(74) *Attorney, Agent, or Firm*—Julio Garceran; Martin I. Finston

(57) ABSTRACT

A circulator is used as a notch filter having a notch at a notch frequency band outside its frequency band of operation as a circulator. It has been observed that circulators operate as a notch filter at a relatively narrow band of operation outside its typical band of operation as a circulator. In certain embodiments, the circulator operates as a narrowband notch filter with sharp edges. Such a notch filter can be used between frequency bands carrying communications signals to reduce energy from one frequency band from spilling into a different frequency band. Since the notch has been observed to be relatively narrow and deep with sharp edges, such a notch filter can be used to reduce the guard bands between frequency bands, thereby increasing the amount of bandwidth that can de used to transmit communications signals. Furthermore, since a typical ferrite circulator is a relatively low cost component, the resulting notch filter can also be of low cost.

4 Claims, 4 Drawing Sheets

NOTCH FILTER SYSTEM AND METHOD

BACKGROUND OF THE INVENTION

1. Field of the Invention

This invention relates to a notch filter system which can be used to filter radio frequency communications signals.

2. Description of Related Art

A filter allows signals having certain frequencies to pass (pass band) while suppressing signals with other frequencies (attenuation band). The frequencies that separate the pass and attenuation bands are the cut-off frequencies. An ideal filter passes the pass band without attenuation and completely suppresses the attenuation band with sharp cut-off edges. In practice, typical filters attenuate the pass band somewhat, do not completely suppress the attenuation band and, at least at higher frequencies, do not have sharp cut-off edges. There are four general categories of filters related to the relation between the pass and attenuation bands: low-pass, high-pass, band-pass and band-stop. A notch or band stop filter passes frequencies below a frequency f1 and above a frequency f2 while suppressing frequencies between the frequencies f1 and f2.

A circulator is a ferrite device, i.e., a device that includes ferrite material. A typical ferrite component will include a compound of iron oxide with impurities of other oxides added. The iron oxide retains the ferromagnetic properties of the iron atoms while the impurities represented by the other oxides increase the ferrite's resistance to current flow. In contrast, elemental iron has good magnetic properties but a very low resistance to current flow. Such low resistance causes eddy currents and significant power losses at high frequencies. Ferrites, on the other hand, have sufficient resistance to be classified as semiconductors.

The magnetic property of any material is a result of electron movement within the atoms of the material. The two basic types of electron motion are the more familiar orbital motion (of the electron around the nucleus of the atom) and the less familiar electron spin (movement of the electron about its own axis). Magnetic fields are generated by current flow. The magnetic fields caused by the spinning electrons spin combine to give a material magnetic properties. In most materials, the spin axes of the electrons are so randomly arranged that the magnetic fields largely cancel out and the material displays no significant magnetic properties. But within some materials, such as iron and nickel, the electron spin axes can be caused to align by applying an external magnetic field. The alignment of the electrons axes within a material causes the magnetic fields to add together with the result that the material exhibits magnetic properties.

In the absence of an external force, the axis of spinning electrons tend to remain pointed in one direction in certain materials. Once aligned, the electrons tend to remain aligned even when the external field is removed. Electron alignment in a ferrite is caused by the orbital motion of the electrons about the nucleus and the force that holds the atom together, i.e., binding forces. When a static magnetic field is applied to the ferrite material, the electrons try to align their spin axes with the external magnetic force. The attempt of the electrons to balance between the external magnetic force and the binding forces causes the electrons to wobble on their axes. The useful magnetic properties of a ferrite is based upon the behavior of the electrons under the influence of an external magnetic field and the resulting wobble frequency.

Reciprocity is a term generally used to describe the transformation of a signal by a device. Fundamentally, if a signal S1 is input to a terminal T1 of a device and a signal S2 is output at a terminal T2 of the device, then the device is considered to be reciprocal if inputting a signal S2 at terminal T2 of the device yields the signal S1 on terminal T1 of the device. Ferrite devices are non-reciprocal devices. Such non-reciprocity is based upon Faraday rotation, in which a linearly polarized plane wave propagating through the ferrite material undergoes a rotation of its polarized direction independently of whether it is propagating in a forward or backward direction if the frequency of the propagating wave is much greater than the wobble frequency.

A circulator is more appropriately described as a non-reciprocal ferrite device. The cross-section of a ferrite device according to the Background Art is depicted in FIG. 1A. There, a circulator 100 includes a conductive launching disk 102 having terminals 104*a*, 104*b*, and 104*c*. Above and below the launching disk 102 are located ferrite disks 106*a* and 106*b*, respectively. Above the ferrite disks 106*a* and 106*b* are located permanent magnets 108*a* and 108*b*, respectively. The operation of the circulator 100 will be described in terms of corresponding FIGS. 1B and 1C.

FIG. 1B is the circuit diagram symbol for the circulator 100 of FIG. 1A. The circulator 100 provides unique transmission paths, allowing RF energy to pass in one direction (namely the rotation direction 110) with little (insertion) loss, but with a high loss (isolation) in the opposite (counter-clockwise) direction. The direction of rotation is determined according to the direction (perpendicular or anti-perpendicular) of the static magnetic field induced through the launching disk 102 by the permanent magnets 108A and 108B.

The direction of rotation 110 in FIG. 1B is clockwise. As depicted in FIG. 1C, if a signal is input to the circulator 100 at terminal 104*a*, then the signal will come out at terminal 104*b*. If a signal is input at terminal 104*b*, then the signal will come out at terminal 104*c*. And if a signal is input at terminal 104*c*, then the signal will come out at terminal 104*a*.

If one of the terminals, e.g., 104*c*, is terminated with an impedance-matched load, then the circulator 100 functions as an isolator. The loaded terminal absorbs the energy passing to it. Hence, in the use of three-terminals, the isolator acts as a device that passes energy in one direction but not in the opposite direction.

A circulator/isolator can be constructed with 2 or more terminals, though a typical number of terminals is 3 or 4.

Wireless communications systems use both circulators/isolators and notch filters. Wireless communications systems include conventional cellular communication systems which comprise a number of cell sites or base stations, geographically distributed to support transmission and receipt of communication signals to and from wireless units which may actually be stationary or fixed. Each cell site handles communications over a particular region called a cell, and the overall coverage area for the cellular communication system is defined by the union of cells for all of the cell sites, where the coverage areas for nearby cell sites overlap to some degree to ensure (if possible) contiguous communications coverage within the outer boundaries of the system's coverage area.

When active, a wireless unit receives signals from at least one base station or cell site over a forward link or downlink and transmits signals to (at least) one cell site or base station over a reverse link or uplink. There are many different schemes for defining wireless links or channels for a cellular communication system, including TDMA (time-division multiple access), FDMA (frequency-division multiple access), and CDMA (code-division multiple access)

schemes. In CDMA communications, different wireless channels are distinguished by different codes or sequences that are used to encode different information streams, which may then be modulated at one or more different carrier frequencies for simultaneous transmission. A receiver can recover a particular information stream from a received signal using the appropriate code or sequence to decode the received signal.

In the wireless communications industry, a service provider is often granted two or more non-contiguous or segregated frequency bands to be used for the wireless transmission and reception of RF communications channels. For example, in the United States, a base station for an "A" band provider for cellular communications receives frequency channels within the A (825–835 MHz), A' (845–846.5 MHz) and A" (824–825 MHz) bands, and the wireless units receive frequency channels within the A (870–880 MHz), A' (890–891.5 MHz) and A" (869–870 MHz) bands. A base station for a B band provider receives frequency channels within the B (835–845 MHz) and B' (846.5–849 MHz) frequency bands, and the wireless units receive frequency channels within the B (880–890 MHz) and B' (891.5–894 MHz) frequency bands. Additionally, a base station for a Personal Communications Systems (PCS) provider may receive frequency channels from wireless units on one or more PCS bands (1850 MHz–1910 MHz), and the wireless units receive frequency channels on one or more PCS bands (1930–1990 MHz).

A circulator can be used which has an operating band encompassing the frequency bands of operation to enable only a single antenna to transmit and receive, which can be referred to as duplex operation. The circulator can be arranged such that signals being transmitted enter into a first terminal of the circulator and are output at a second terminal to the antenna. Signals received at the antenna can be input into the second terminal and produced at a third terminal to the receiver circuitry.

Filters are used to prevent energy from one frequency band from interfering with another frequency band. Here, the frequency band can be narrower than the frequency bands described above or wider. For example, the frequency band can be a 1.25 MHz wide CDMA loaded carrier or a 5 MHZ wideband CDMA loaded carrier within the frequency bands described above. However, due to the finite roll-off characteristics of filters in the radio receiver, a signal from an adjacent band may come through the radio receiver at a power level strong enough to interfere with an adjacent band. To help prevent this, guard bands are used to space the carrier frequency bands apart. However, the use of guard bands removes bandwidth which can be used to transmit actual communications signals.

SUMMARY OF THE INVENTION

The present invention involves using a circulator as a notch filter having a notch at a notch frequency band outside its frequency band of operation as a circulator. It has been observed that circulators operate as a notch filter at a relatively narrow band of operation outside its typical band of operation as a circulator. In certain embodiments, the circulator operates as a narrowband notch filter with sharp edges. Such a notch filter can be used between frequency bands carrying communications signals to reduce energy from one frequency band from spilling into a different frequency band. Since the notch has been observed to be relatively narrow and deep with sharp edges, such a notch filter can be used to reduce the guard bands between frequency bands, thereby increasing the amount of bandwidth that can de used to transmit communications signals. Furthermore, since a typical ferrite circulator is a relatively low cost component, the resulting notch filter can also be of low cost.

BRIEF DESCRIPTION OF THE DRAWINGS

Other aspects and advantages of the present invention may become apparent upon reading the following detailed description and upon reference to the drawings in which.

DETAILED DESCRIPTION

Figure 1A:
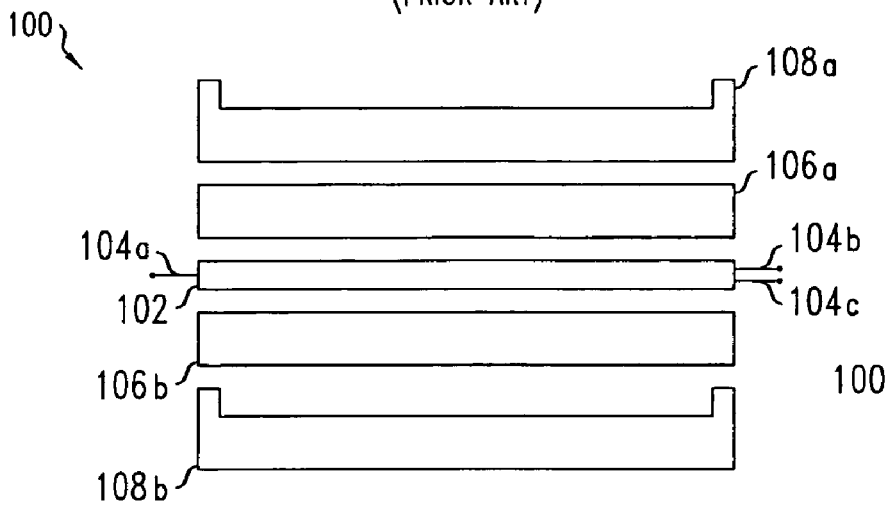
FIG. 1A (PRIOR ART)
FIGS. 1A–C show general diagrams of a typical circulator to describe the normal operation of a circulator.
Figure 1B:
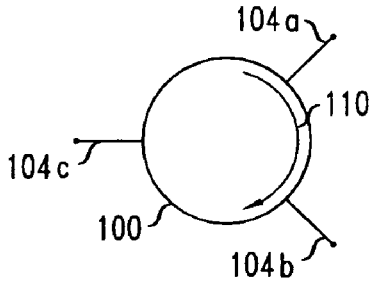
FIG. 1B (PRIOR ART)
Figure 1C:
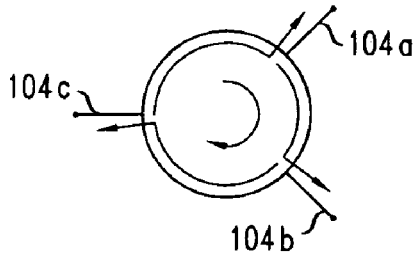
FIG. 1C (PRIOR ART)

Illustrative embodiments of a notch filter system using a circulator according to the principles of the present invention are described below. As is shown in FIGS. 1A–C, the typical circulator 100, such as a coaxial point junction circulator, includes the first terminal 104*a*, the second terminal 104*b* and the third terminal 104*c*. In the frequency band of circulator operation, such as the frequency bands for radio frequency (RF) communication signals to be transmitted or received, energy input into the first terminal 104*a* is produced in the direction indicated by the arrow at the second terminal 104*b* with minimal loss, for example 0.15 dB of insertion loss. However, the signal is not produced at the third terminal 104*c*, for example attenuated by an isolation loss of −25 dB. Similarly, energy input into the second terminal 104*b* is produced in the direction of the arrow at the third terminal 104*c* with minimal loss but severely attenuated at the first terminal 104*a*. Finally, energy into the third terminal 104*c* is produced in the direction of the arrow at the first terminal 104*a* but severely attenuated at the second terminal 104*b*.

Figure 2:
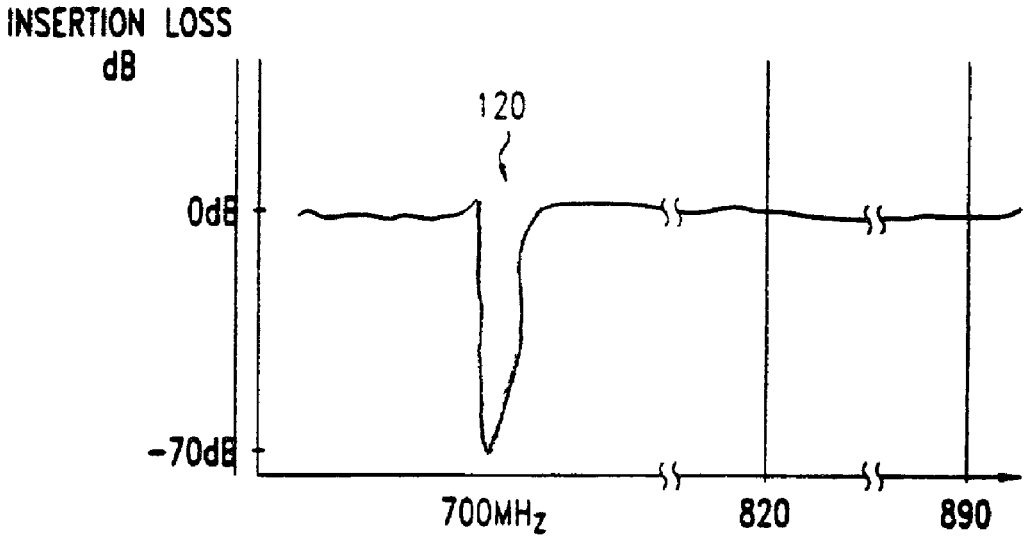
FIG. 2 shows a notch filter characteristic curve which has been discovered outside the normal frequency band of operation of a circulator.

FIG. 2 shows a response of example insertion loss characteristics for a typical circulator over frequency. In this example, the circulator exhibits a low insertion loss across terminals over an example frequency band of between 820 to 890 Megahertz (MHz). However, it has been observed that at a notch frequency, for example 700 MHz, the circulator has a narrowband notch 120 with relatively steep sides and a relatively narrow width, for example in the kilohertz range. The notch 120 is relatively deep, for example −70 dB. Outside of the notch frequencies or notch frequency band, the circulator exhibits a relatively low insertion loss. Thus, the notch filter of the present invention can provide a relatively high quality notch filter at low cost.

Figure 3:
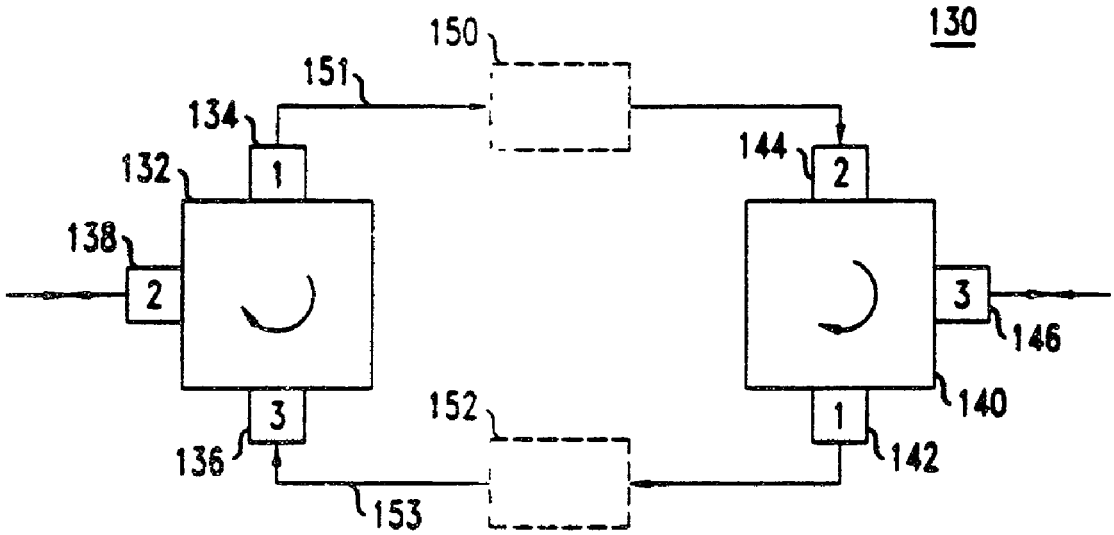
FIG. 3 shows an embodiment of a notch filter system using notch filters according to principles of the present invention.

In another embodiment of the notch filter system, FIG. 3 show a notch filter arrangement 130 which includes a first three-terminal circulator 132 with three terminals 134, 136 and 138 and a second three-port circulator 140 with three terminals 142, 144 and 146. The circulators 132 and 140 can be conventional coaxial point junction circulators. In this example, the circulators 132 and 140 are arranged back to back such that the first terminal 134 of the first circulator 132 is connected to the second terminal 144 of the second circulator 140, and the second terminal 136 of the first circulator 132 is connected to the first terminal 142 of the second circulator 140. The individual circulators 132 and 140 can be constructed as would be understood by one of ordinary skill in the art such that their respective notch frequencies are between frequency bands used to carry communications signals.

Figure 4:
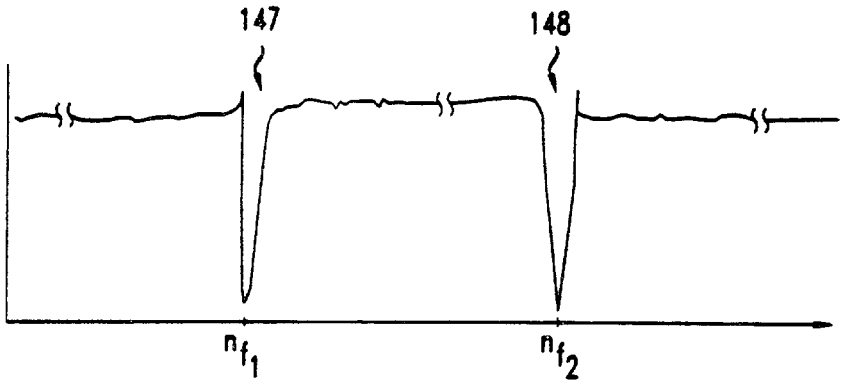
FIG. 4 shows a characteristic curve for a notch filter system pairing notch filters according to principles of the present invention.

For example FIG. 4 shows a response of the attenuation characteristics for an example of the notch filter arrangement 130 of FIG. 3. In this example, the first circulator 132 has been constructed such that it has a notch 147 at a notch frequency of $n_{f1}$, and the circulator 140 has been constructed such that it has a notch 148 at a notch frequency $n_{f2}$. Accordingly, a frequency band within the frequency of $n_{f1}$ and $n_{f2}$ will be effectively isolated from frequency bands outside the frequencies $n_{f1}$ and $n_{f2}$.

As described thus far, the notch filter arrangement 130 is bi-directional in that a signal entering the arrangement 130 from either the third terminal 138 of the first circulator 132 or the third terminal 146 of the second circulator 140 will be frequency shaped in the same fashion by the response shown in FIG. 4. In certain embodiments, the notch filter arrangement 30 can include a frequency adjustment element 150 associated with the connection or phase shift path 151 between the first terminal 134 of the first circulator 132 and the second terminal 144 of the second circulator 140 and/or a frequency adjustment element 152 associated with the connection or phase shift path 153 between the second terminal 136 of the first circulator 132 and the first terminal 142 of the second circulator 140. Such frequency adjustment elements 150 and/or 152 can be a phase shifter. The notch frequency adjustment element 150 can be used to effectively adjust the notch frequency for the signals input into the second terminal 144 of the second circulator 140 and output from the third terminal 146 of the second circulator 140. The frequency adjustment element 152 can be used to effectively adjust the notch frequency for the signals input into the second terminal 136 of the first circulator 132 and output from the third terminal 138 of the first circulator 132. For example, the frequency adjustment element(s) 150 and/or 152 can provide fine adjustments to the notch frequencies $n_{f1}$ and/or $n_{f2}$, such as to provide component frequency stabilization as component temperature changes.

In this embodiment, since each path 151 and 153 has independent notch frequency adjustment parameters, the notch filter arrangement 30 can provide the same notch filter frequencies for the uplink and downlink communications signals, or each path 151 and 153 can be adjusted for specific frequency set points without effecting the other path.

Figure 5A:
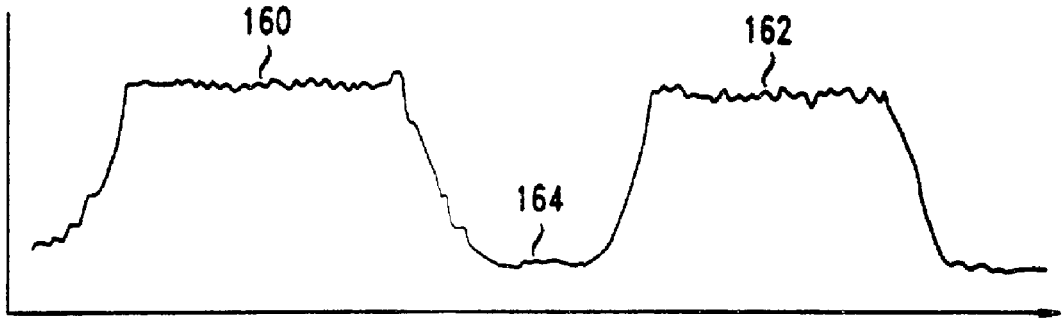
FIGS. 5*a* and 5*b* show how the notch filter system can be used to filter carrier frequency pulses to reduce the guard band requirements between carrier frequency bands.
Figure 5B:
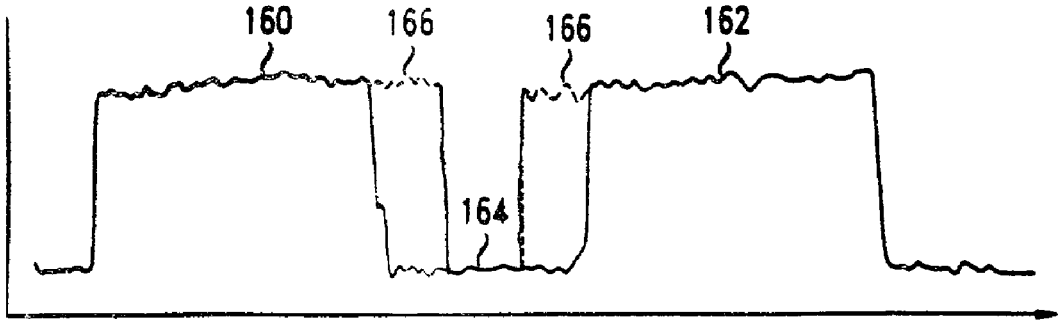

In accordance with certain principles of the present invention, the notch filter system, which can include the notch filter and/or the notch filter arrangement described above and/or combinations or variations of notch filter(s) and/or notch filter arrangements, can be used to decrease the guard bandwidth used between radio frequency bands carrying communications signals. By reducing the guard bandwidth, the operational bandwidth used to carry communications signals can be increased. For example, as shown in FIG. 5*a*, current CDMA systems use 1.25 MHz carriers, such as carrier pulses 160 and 162, separated by guard bands, such as guard band 164, which is about 625 KHz wide. If the guard band requirements are decreased, without decreasing the communication performance, more bandwidth could be used to carry communications traffic, such as voice, video and/or data. Filters that are now used to shape forward and trailing edges of each of the carrier pulses 160 and 162 have a specific response geometry and can be improved at higher costs and size. By using the notch filter according to the principles of the present invention, one can obtain a notch filter response, for example by combining notch filter pairs, to provide an improved rising and falling edge response as shown in FIG. 5*b*. Accordingly, by using the low cost and small size components used to implement certain embodiments of the notch filter system, the guard bandwidth can be reduced, thus allowing more operating bandwidth for communications, for example by increasing the bandwidth of the carrier pulses 160 and 162 into the bandwidth of the guard band 164 as shown by dashed lines 166.

Figure 6:
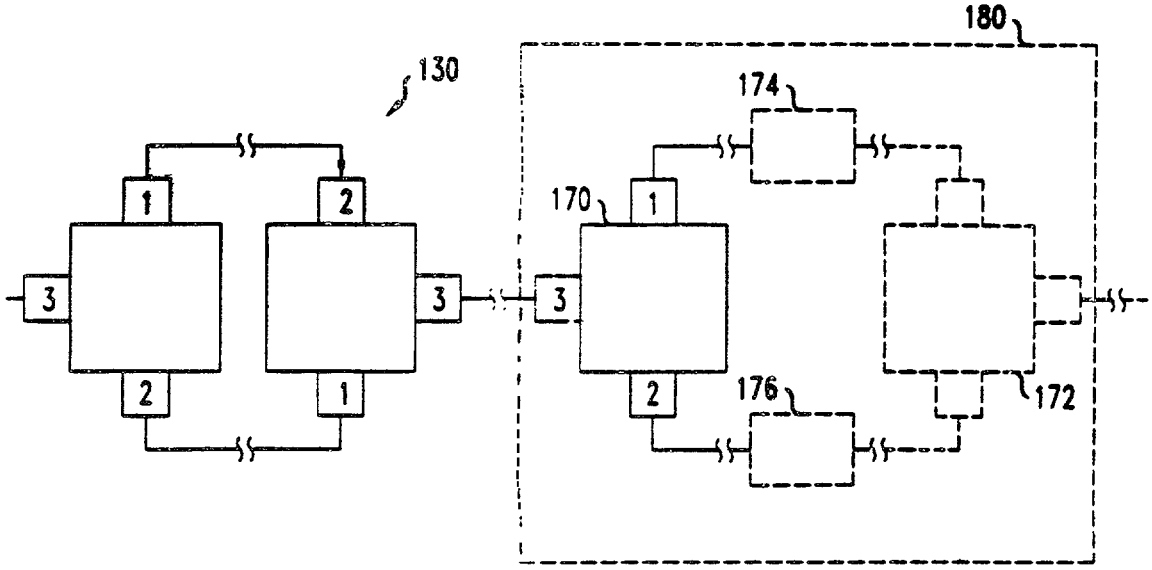
FIG. 6 shows another embodiment of a notch filter system using multiple cascaded notch filters.

In addition to the embodiment described above, alternative configurations of the notch filter system according to principles of the present invention are possible which omit and/or add components and/or use variations or portions of the described receiver architecture. For example, the described notch filter uses a three terminal circulator which operates as a bi-directional notch filter outside the normal circulator operating frequencies. However, different embodiments are possible. For example, a notch filter could be constructed using the same ferro-magnetic effect used in a typical circulator or isolator to produce a uni-directional notch filter with only two terminals as would be understood by one of ordinary skill in the art. Additionally, a notch filter system can be produced with circulators/isolators having additional terminals and/or with additional levels or stages of circulators/isolators. Moreover, a bi-directional notch filter system can include uni-directional notch filter(s) on the path used for transmission and/or reception. Depending on the embodiment, a notch filter system can include circulator/isolators having different numbers of terminals can be coupled to produce a desired notch filter system response to transmit and/or receive signals on multiple and/or different antennas or paths. Various notch filter arrangements are possible. As shown in FIG. 6, additional circulator(s) 170 and 172 can be cascaded (series coupled) to increase the notch filter attenuation band by having overlapping notch bands or to produce additional notch frequencies or different notch filter system characteristics. Additional notch filter systems 174 and 176 can be coupled on paths between the notch filters 170 and 172 to produce a larger notch filter arrangement 180. In FIG. 6, bi-directional and/or duplex operation can still be achieved if desired. Also, switched phase shifters 150 and 152 can be used to provide synchronized switch filter response for special desired applications. (i.e. tactical systems). As used herein, the term circulator can be used to encompass isolators or other non-reciprocal devices which rely on a ferro-magnetic or analogous material-magnetic effect to produce the described notch filter system.

Furthermore, as would be understood by one of skill in the art, the notch filter system can be used to filter analog or digital signals of different frequency bands or in different schemes. The analog or digital signals can be characterized as wideband, broadband and/or narrowband. The notch filter system has been described with particular reference to frequency band(s) associated with cellular communications systems, but the notch filter system according to principles of the present invention can be used in cellular, satellite and other wireless communications systems as well as non-wireless communications systems. Additionally, the notch filter system has been described using a particular configuration of distinct components, but it should be understood that the notch filter system and portions thereof can be implemented using different configurations of different components to achieve the desired operation as would be understood by one of ordinary skill in the art with the benefit of this disclosure. For example, the term circulator used in the present application can encompass a device which operates as a non-reciprocal device at some frequency bands but as a notch filter at other frequency bands or as a non-reciprocal notch filter at other frequency bands. What has been described is merely illustrative of the application of the principles of the present invention. Those skilled in the art will readily recognize that these and various other modifications, arrangements and methods can be made to the present invention without strictly following the exemplary applications illustrated and described herein and without departing from the spirit and scope of the present invention.

The invention claimed is:

1. A method of filtering a signal which occupies an operating frequency band, comprising:

presenting the signal as input at a terminal of a circulator having an inherent band-stop characteristic selected to attenuate those frequencies that lie within a notch frequency band situated near an edge of the operating frequency band;

passing the signal through the circulator to a subsequent terminal thereof such that during said passage, frequency content within the notch frequency band is substantially attenuated from the signal; and extracting the signal from said subsequent terminal of the circulator.

2. The method of claim 1, wherein the notch frequency band is situated at an edge of a radio frequency band of operation which carries communications signals.

3. The method of claim 2 comprising:

using a second circulator as a notch filter to attenuate signals within a second notch frequency band which is outside the operating frequency band of circular operation of said second circulator.

4. The method of claim 3 comprising:

filtering signals within said second notch frequency band at a second edge of said radio frequency band of operation which carries communications signals.

* * * * *